US006400080B1

(12) United States Patent
Tanaka

(10) Patent No.: US 6,400,080 B1
(45) Date of Patent: Jun. 4, 2002

(54) PLASMA DISPLAY PANEL HAVING A SEALING LAYER AND FIRST, SECOND, AND THIRD WALLS

(75) Inventor: Yukio Tanaka, Yamanashi (JP)

(73) Assignee: Pioneer Corporation, Tokyo (JP)

( * ) Notice: Subject to any disclaimer, the term of this patent is extended or adjusted under 35 U.S.C. 154(b) by 0 days.

(21) Appl. No.: 09/533,241

(22) Filed: Mar. 22, 2000

(30) Foreign Application Priority Data

Mar. 26, 1999 (JP) ..... 11-083561

(51) Int. Cl.[7] ..... H01J 17/49

(52) U.S. Cl. ..... 313/582; 313/609; 313/610; 313/634; 313/493

(58) Field of Search ..... 313/582, 609, 313/610, 634, 493

(56) References Cited

U.S. PATENT DOCUMENTS 5,428,263 A * 6/1995 Nagano ..... 313/585
5,757,131 A * 5/1998 Tsuchiya ..... 313/582
5,886,467 A * 3/1999 Kimura ..... 313/582
5,914,563 A * 6/1999 Lee et al. ..... 313/585
5,984,747 A * 11/1999 Bhagavatula et al. ..... 445/24
6,236,159 B1 * 5/2001 Inoue et al. ..... 313/582
6,326,937 B1 * 12/2001 Hayashi ..... 345/60

FOREIGN PATENT DOCUMENTS

JP 09063488 A * 3/1997
JP 2000030618 A * 1/2000
JP 2000036254 A * 2/2000

* cited by examiner

*Primary Examiner*—Vip Patel
*Assistant Examiner*—Kevin Quarterman
(74) *Attorney, Agent, or Firm*—Sughrue Mion, PLLC

(57) ABSTRACT

Disclosed is a plasma display panel that enables providing stabilized discharge characteristics of the panel. In the regions on a rear glass substrate inside a sealing layer and outside a display region, formed are second walls having a plurality of discontinuous portions and extending substantially in parallel to the sealing layer, and third walls opposed to the discontinuous portions of the second walls substantially in parallel to the sealing layer.

3 Claims, 3 Drawing Sheets

II-II CROSS SECTION

II-II CROSS SECTION

III-III CROSS SECTION

PLASMA DISPLAY PANEL HAVING A SEALING LAYER AND FIRST, SECOND, AND THIRD WALLS

BACKGROUND OF THE INVENTION

1. Field of the Invention

The present invention relates to a plasma display panel (PDP) and, more particularly, to a sealing structure for forming a discharge space of the PDP.

2. Description of Related Art

A conventional PDP has a configuration in which, a pair of electrode rows, a dielectric layer for covering the electrode rows, and a protection layer for covering the dielectric layer (MgO layer), are formed in sequence on a display side glass substrate. On a rear glass substrate, on the other hand, formed in sequence are electrode columns orthogonal to the electrode rows, walls for defining discharge spaces formed between the electrode columns, and a fluorescent layer for covering the electrode columns and the side of the walls.

Subsequently, low melting-point glass paste having low melting-point glass flit and a binder mixed together is applied in the shape of a frame by means of a screen printing or the like to the peripheral portion on any one of the glass substrates. Then, the glass substrate is temporarily baked to form a sealing layer (a low melting-point glass layer).

Subsequently, both glass substrates are superimposed and heat treated at a temperature of 400° C. with both substrates pressed against each other, thereby softening the sealing layer to be sealed. Then, the air between the glass substrates is exhausted and a discharge gas is sealed therebetween to complete a PDP.

Furthermore, since the sealing layer is composed of low melting-point glass paste, the layer generates a large quantity of thermally decomposed gases at the time of sealing during the heat treatment.

Accordingly, in the exhaust process after sealing, impure gases such as moisture and carbon dioxide remaining or trapped in the sealing layer are to be exhausted by heating the glass substrates to a temperature of 350–400° C. near the softening point of the sealing layer. However, even in the panel which has been exhausted and has a discharge gas sealed, the impure gases remaining in the sealing layer are unavoidably released. This causes the surface of the protection film to be contaminated or the composition of the discharge gas to deteriorate, providing potential unstable discharge characteristics.

OBJECTS AND SUMMARY OF THE INVENTION

The present invention has been developed in view of the aforementioned problems. An object of the present invention is to provide a plasma display panel that is designed to provide stabilized discharge characteristics of the panel.

The plasma display panel according to a first aspect of the present invention is a plasma display panel comprising a sealing layer for sealing a peripheral portion of a pair of substrates opposed to each other across a discharge space and first walls for defining the discharge space of a display region, wherein on one of the substrates, in regions inside the sealing layer and outside the display region, second walls extended substantially in parallel to the sealing layer and having discontinuous portions and third walls opposed to the discontinuous portions of the second walls are formed.

The plasma display panel, according to a second aspect of the present invention, is the plasma display panel according to the first aspect of the present invention characterized in that the second and third walls have substantially the same height and width as those of the first walls, and are made of a low melting-point glass which is used for forming the first walls.

The plasma display panel, according to a third aspect of the present invention, is the plasma display panel according to the first aspect of the present invention characterized in that the first through third walls are formed by patterning a glass layer, comprised of low melting-point glass formed on one substrate, at the same time in accordance with respective patterns.

On one of the substrates, in regions inside the sealing layer and outside the display region, second walls extended substantially in parallel to the sealing layer and having discontinuous portions and third walls opposed to the discontinuous portions thereof are formed. This can prevent impure gases released from the sealing layer from being diffused into the display region and stabilize the processes for forming the second and third walls.

Furthermore, the manufacturing processes can be provided with improved efficiency and simplified by means of the simultaneous formation of the first through third walls.

DETAILED DESCRIPTION OF THE PREFERRED EMBODIMENTS

The embodiments of the present invention will be explained below with reference to the drawings.

Figure 1:
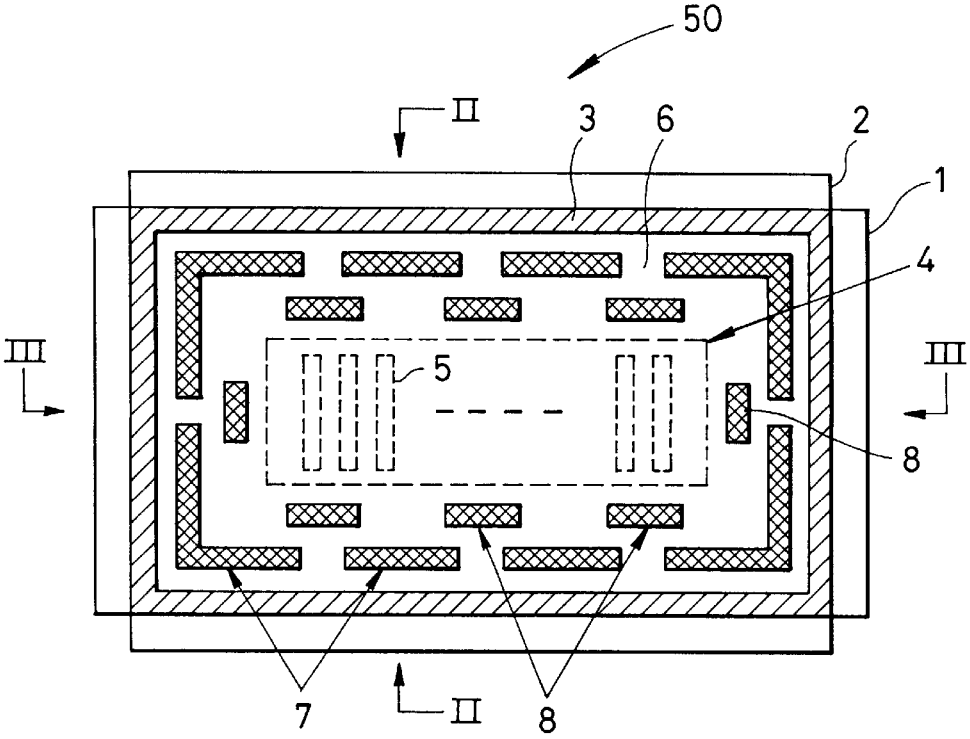
FIG. 1 through FIG. 3 are schematic views showing a PDP according to a first embodiment of the present invention.
Figure 2:
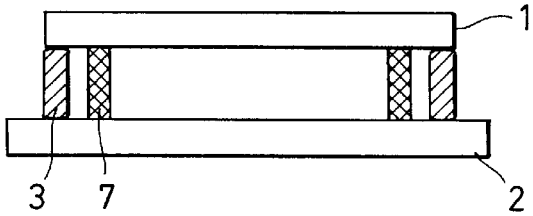

FIG. 1 is a view of a main portion of the structure of a PDP 50 according to a first embodiment of the present invention, showing the plan view of the PDP 50; FIG. 2 shows a cross-sectional view taken along line II—II of FIG. 1; and FIG. 3 shows a cross-sectional view taken along line III—III of FIG. 1, respectively.

Figure 3:
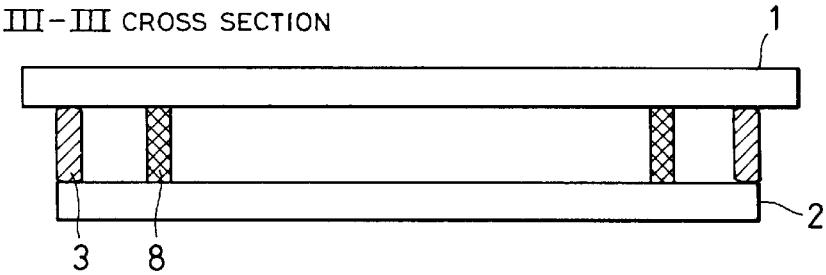

As shown in FIG. 1 through FIG. 3, the PDP 50, according to the first embodiment of the present invention, has a structure that a front glass substrate 1 is opposed to a rear glass substrate 2 across discharge spaces (not shown); the peripheral portion is sealed with a sealing layer 3; and first walls 5 are formed to define the discharge spaces of a display region 4. In addition, second walls 7 are formed on the rear glass substrate 2 inside the sealing layer 3 and outside the display region 4, the second walls 7 having a plurality of discontinuous portions 6 (notches or gaps) extending substantially in parallel to the sealing layer 3. Moreover, third walls 8 are formed substantially in parallel to the sealing layer 3 outside the display region 4 at positions opposed to the discontinuous portions 6 of the second walls 7.

The second and third walls 7 and 8 are substantially the same as the first walls 5 in height and in width, and made of the same low melting-point glass as the first walls 5.

In the PDP 50 according to the first embodiment of the present invention, the second walls 7 having a plurality of discontinuous portions 6 are formed inside the sealing layer 3. In addition, the third walls 8 are formed so as to block the clearances of the discontinuous portions 6. Accordingly, these walls prevent impure gases released on forming the sealing layer 3 from being diffused into the display region 4, so that the surface of a protection film is prevented from being contaminated, providing stabilized discharge characteristics of the panel.

Moreover, the second walls 7 are separated and shortened in length by the discontinuous portions 6. Thus, when a resist mask is removed that is to be used in a wall forming process, which is described later, the resist mask hardly remains.

In addition, the second and third walls 7 and 8, in a wall forming process which is described later, can be substantially the same as the first walls 5 in height and in width, and can be made simultaneously of the same low melting-point glass as the first walls 5. Thus, this enables improving and simplifying the efficiency of the fabrication processes.

Figure 4:
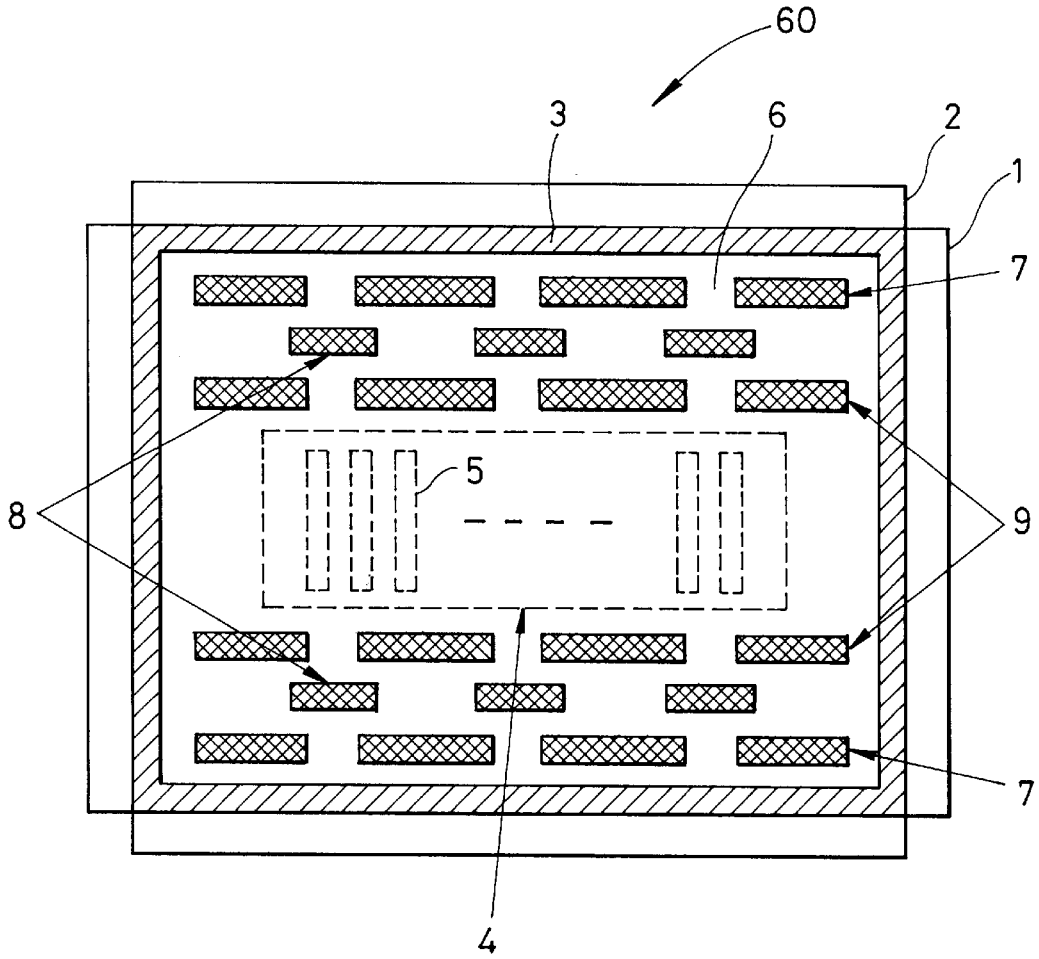
FIG. 4 is a schematic view showing a PDP according to a second embodiment of the present invention.

FIG. 4 is a plan view showing a PDP 60 according to a second embodiment of the present invention.

The PDP 60 of the second embodiment of the present invention is provided in sequence substantially in parallel to a sealing layer 3, in the upper and lower regions defined inside the sealing layer 3 and outside the display region 4, with second walls 7 having a plurality of discontinuous portions 6, third walls 8 disposed opposing the discontinuous portions 6 of the second walls 7, and fourth walls 9 for blocking the clearances of the third walls 8.

The PDP 60 of the second embodiment of the present invention provides a further improved effect of preventing impure gases released from the sealing layer 3 from being diffused into the display region 4, owing to the forming of the second through fourth walls 7, 8 and 9 as mentioned above.

Moreover, the second through fourth walls 7, 8 and 9 are separated and shortened in length by the discontinuous portions, respectively. Thus, when a resist mask 11 is removed that is to be used in a wall forming process, which is described later, the resist mask 11 hardly remains, thus stabilizing the processes.

Next, a method for forming the first through fourth walls 5, 7, 8 and 9 according to this embodiment of the present invention is explained with reference to FIG. 5 through FIG. 8. Furthermore, FIG. 5 through FIG. 8 show only the first through fourth walls 7, 8 and 9 with those not requiring explanation omitted.

Figure 5:
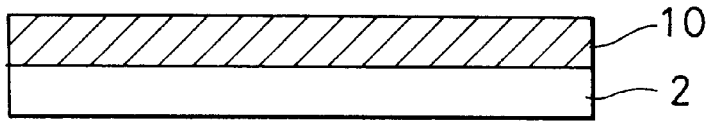
FIG. 5 through FIG. 8 are explanatory views showing the steps for forming a first through fourth wall of the present invention.

First, as shown in FIG. 5, low melting-point glass paste having low melting-point glass flit and binder mixed together is applied uniformly to the rear glass substrate 2 on which electrode rows (not shown) and an electrode protection layer covering the electrode columns are formed. Thus, formed is a glass material layer 10 for forming the first through fourth walls.

Figure 6:
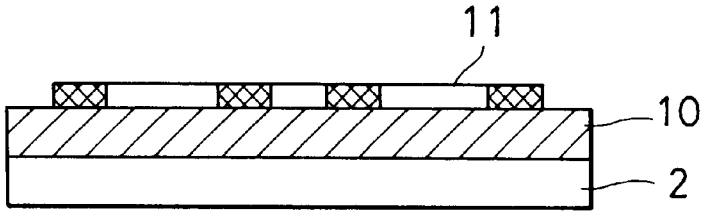

Subsequently, as shown in FIG. 6, a dry film comprised of a photo-resist material with a sand blast resistance property is stacked on the glass material layer 10. Then, formed is a resist mask 11 that is patterned so as to mask the regions of the respective first through fourth walls on said film by means of photolithography.

Figure 7:
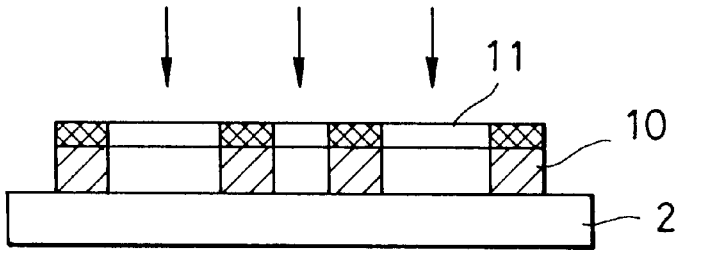

Subsequently, as shown in FIG. 7, the glass material layer 10 except the first through fourth walls is selectively cut away by means of sand blasting from the surface of the resist mask 11 (in the direction indicated by the arrows in the drawing). Thus, the respective walls are formed into predetermined patterns.

Figure 8:
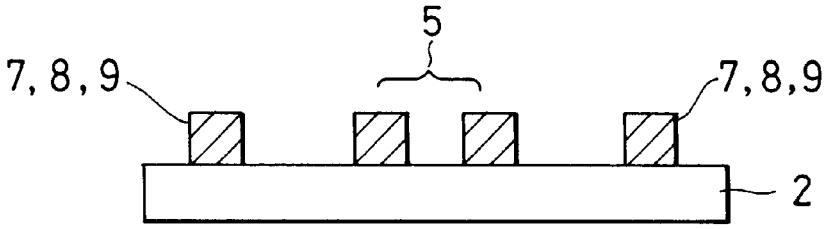

Subsequently, as shown in FIG. 8, the resist mask 11 that has been used as a mask is stripped away and then the patterned glass material layer 10 is baked, thus forming the first walls 5 and the second through fourth walls 7, 8 and 9.

Here, if the second through fourth walls are formed discontinuously as shown in FIG. 1 through FIG. 8, any peeling of the resist mask 11 hardly remains when the resist mask 11 is removed, thus stabilizing the process.

Thereafter, fluorescent paste is filled in the clearances of the first walls 5 by means of the screen printing and then baked, thus a fluorescent layer being formed so as to cover the side of the first walls 5 and the electrode protection layer of the electrode columns.

Subsequently, as shown in FIG. 1 through FIG. 3, the sealing layer 3 (a low melting-point glass layer) in the shape of a frame outside the second walls 7; and, the rear glass substrate 2 and the front glass substrate 1 are superimposed opposed to each other and heated to a temperature within a range of 350–450° C., allowing the sealing layer 3 to melt in order to seal the periphery; then, the air is exhausted and a gas is introduced therein, thereby completing the panel.

Here, the walls for preventing impure gases from being diffused (the second through fourth walls 7, 8, and 9), formed inside the sealing layer 3, prevent impure gases from being diffused into the display region 4, thus enabling to provide stabilized discharge characteristics of the panel.

According to the present invention, the first walls separated by discontinuous portions and the second walls opposed to the discontinuous portions are provided inside the sealing layer. This enables preventing impure gases from being diffused into the display region and preventing the resist mask having a film shape used for forming walls from remaining when the resist mask is removed. The discharge characteristics of the panel and the processes for manufacturing the panel can be thereby stabilized.

What is claimed is:

1. A plasma display panel comprising a sealing layer for sealing a peripheral portion of a pair of substrates opposed to each other across a discharge space and first walls for defining said discharge space of a display region, wherein on one of said substrates, in regions inside said sealing layer and outside said display region, second walls extended substantially in parallel to said sealing layer and having discontinuous portions and third walls opposed to the discontinuous portions of said second walls are formed.

2. The plasma display panel according to claim 1, wherein said second and third walls have substantially the same height and width as those of said first walls, and are made of a low melting-point glass which is used for forming said first walls.

3. The plasma display panel according to claim 1, wherein said first through third walls are formed by patterning a glass layer, comprised of low melting-point glass formed on said one substrate, at the same time in accordance with respective patterns.

* * * * *